US005789688A

United States Patent [19]

Schiano

[11] Patent Number: 5,789,688

[45] Date of Patent: Aug. 4, 1998

[54] DRUM SET ACTUATOR

[76] Inventor: Mark Schiano, 216 Rockland Rd., Pearl River, N.Y. 10965

[21] Appl. No.: 840,867

[22] Filed: Apr. 17, 1997

[51] Int. Cl.[6] ..... G10D 13/02

[52] U.S. Cl. ..... 84/422.1

[58] Field of Search ..... 84/422.1, 422.2, 84/422.3

[56] References Cited

U.S. PATENT DOCUMENTS

| | | | |
|---|---|---|---|
| 3,125,921 | 3/1964 | Korosh | 84/422.1 |
| 3,747,464 | 7/1973 | Russell | 84/422.1 |
| 5,267,500 | 12/1993 | Lombardi | 84/402 |

*Primary Examiner*—Michael L. Gellner
*Assistant Examiner*—Shih-Yung Hsich
*Attorney, Agent, or Firm*—Stanley J. Yavner

[57] ABSTRACT

The invention relates to a mechanism for selectively actuating two high hats and a bass drum of a drum set. Normally, a bass drum and high hat (cymbals) are actuated with separate pedals by a drummer, but with today's more complex music, it becomes more convenient for the drummer if a pair of high hats and a bass drum are actuated by one foot, and additionally, a second beater for the bass drum is actuated by the other foot. The structure of the invention provides a single pedal with associated three buttons for separate actuation of a first high hat, a second high hat and a bass drum (middle button). The three buttons, in simple terms, cause a rocker arm to tilt one way or the other by the actuation of the first and third buttons. The middle button places the rocker arm in a neutral or level position to actuate the bass drum. The rocker arm, in turn, rotates a rotary piece with a protrusion for insertion to a gear; and another rotary piece with a protrusion inserts to another gear, depending upon which of the buttons are depressed.

6 Claims, 8 Drawing Sheets 10
12
6
92
90
78
102
104
76
72
82,84
32
64
70
66
70
54
58
52
44
48
62
60
6

DRUM SET ACTUATOR

FIELD OF THE INVENTION

This invention relates primarily to musical instruments and more particularly to musical instruments of the drum-set type, including cymbal high hats and a bass drum.

BACKGROUND OF THE INVENTION

Drum sets are common for musicians to provide drum and cymbal sounds by use of the hands and feet of the musician.

For many years, a part of the typical drum set would include one or more high hats and a bass drum, as well as other drum set instrumentation. With particular reference to the bass drum and the high hats, actuation is usually by use of the right foot of the drummer, depressing a pedal for the bass drum, and the left foot for the high hat, also by use of a pedal. Complexity occurs with these typical drum sets when actuation of more than one high hat is used. In that case, the left foot of the drummer is occupied by going back and forth from one high hat pedal to another, as needed and quickly consecutive actuation of the high hats becomes a near impossibility. Furthermore, more complexity arises when the bass drum has more than one beater, which may, on occasion require simultaneous actuation of both beaters for the bass drum. It is easily seen that the left foot, at the expense of the high hat actuation, becomes necessary for depressing the second pedal of the bass drum.

An invention of Charles Korosh, disclosed in U.S. Pat. No. 3,125,921, issued Mar. 24, 1964, teaches a mechanism wherein a plurality of instruments are actuated by a single pedal. Nevertheless, the mechanism is distinguishable from the mechanism disclosed herein. Korosh, for instance, recommends the use of counter-rotating blocks, with bushings and bellcranks. The concepts of auxiliary buttons to a pedal and key slide engagers of the preent invention are never taught or shown by Korosh. Therefore, the Korosh mechanism does not have the flexibility and capability of the present invention.

OBJECTS AND SUMMARY OF THE PRESENT INVENTION

Accordingly, a primary object of the present invention is to provide a mechanism for use in a drum set which includes multiple drum beater pedals and beaters and multiple high hats, without resorting to the use of the drummer's hands, which are of course otherwise occupied.

A further and more particular object of the present invention is to provide a mechanism whereby one or more of the actuation pedals, for either high hat or bass drum actuation includes sub-pedals or buttons on a single pedal, for extending the actuation capability.

These and other objects of the present invention are provided in a drum set which includes a right foot pedal for only bass drum beater actuation with a second drum beater, a left foot pedal for multiple high hat and base drum beater actuation with a first drum beater, selectively. In accordance with this invention, the left foot pedal has associated therewith a set of three buttons connected to a rocker arm. The depression of the first button tips the rocker arm in one direction, a depression of the third button tips the rocker arm in the other direction, and depression of the middle or second button levels the rocker arm. The tilting of the rocker arm, or the leveling thereof, sets in motion a mechanism whose purpose ultimately is to connect either the first high hat or the second high hat or the first drum beater, to the first or left pedal, so that depression of the left foot pedal engages the cymbals of the first high hat, or the cymbals of the second high hat, or the first drum beater with the face of the bass drum. In other words, after engagement with one of the buttons, it is thereafter determined, until another of the three buttons is depressed, that motion is instituted by depression of the first foot pedal. If the left or first button is depressed, and then a repetitive motion with the drummer's foot on the first foot pedal is instituted, the first high hat cymbals will repetitively engage and will be actuated.

BRIEF DESCRIPTION OF THE DRAWINGS

These and other objects, features and advantages of the present invention will become apparent by reference to the following more detailed description of the preferred, but nonetheless illustrative, embodiment of the present invention, with reference to the accompanying drawings, wherein.

DETAILED DESCRIPTION OF A PREFERRED EMBODIMENT FOR THE PRESENT INVENTION

Figure 1:
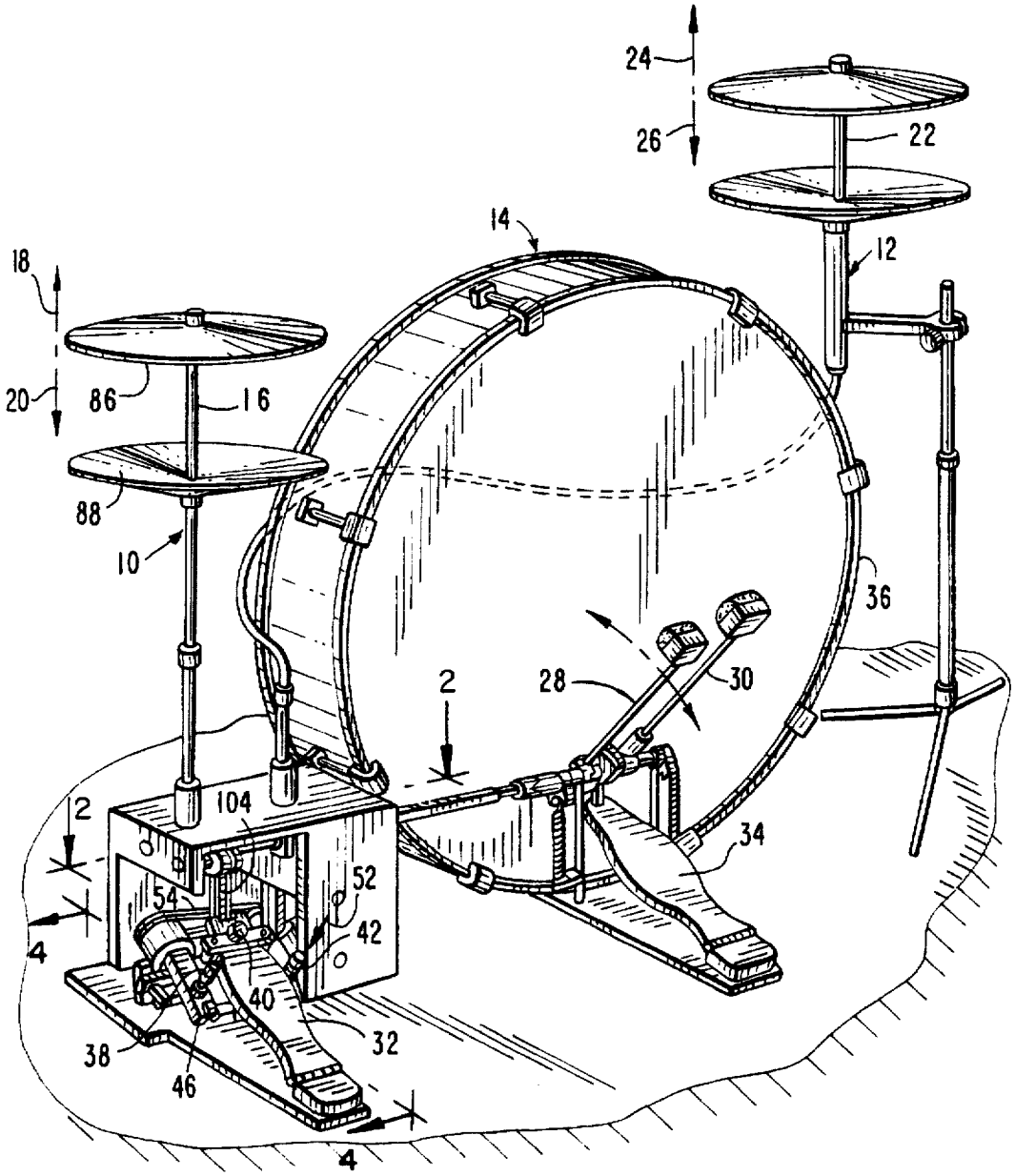
FIG. 1 is an isometric view of a bass drum and multiple high hat drum and cymbal sets according to the present invention, with a second foot pedal for the bass drum shown to actuate a second drum beater by use of the right foot, and a first pedal with a mechanism for actuation of first and second cymbal high hats and a first beater for the bass drum.

Referring to the drawings, a bass drum and double high hat set are shown with associated mechanisms for accomplishing the objectives of the present invention.

Figure 2:
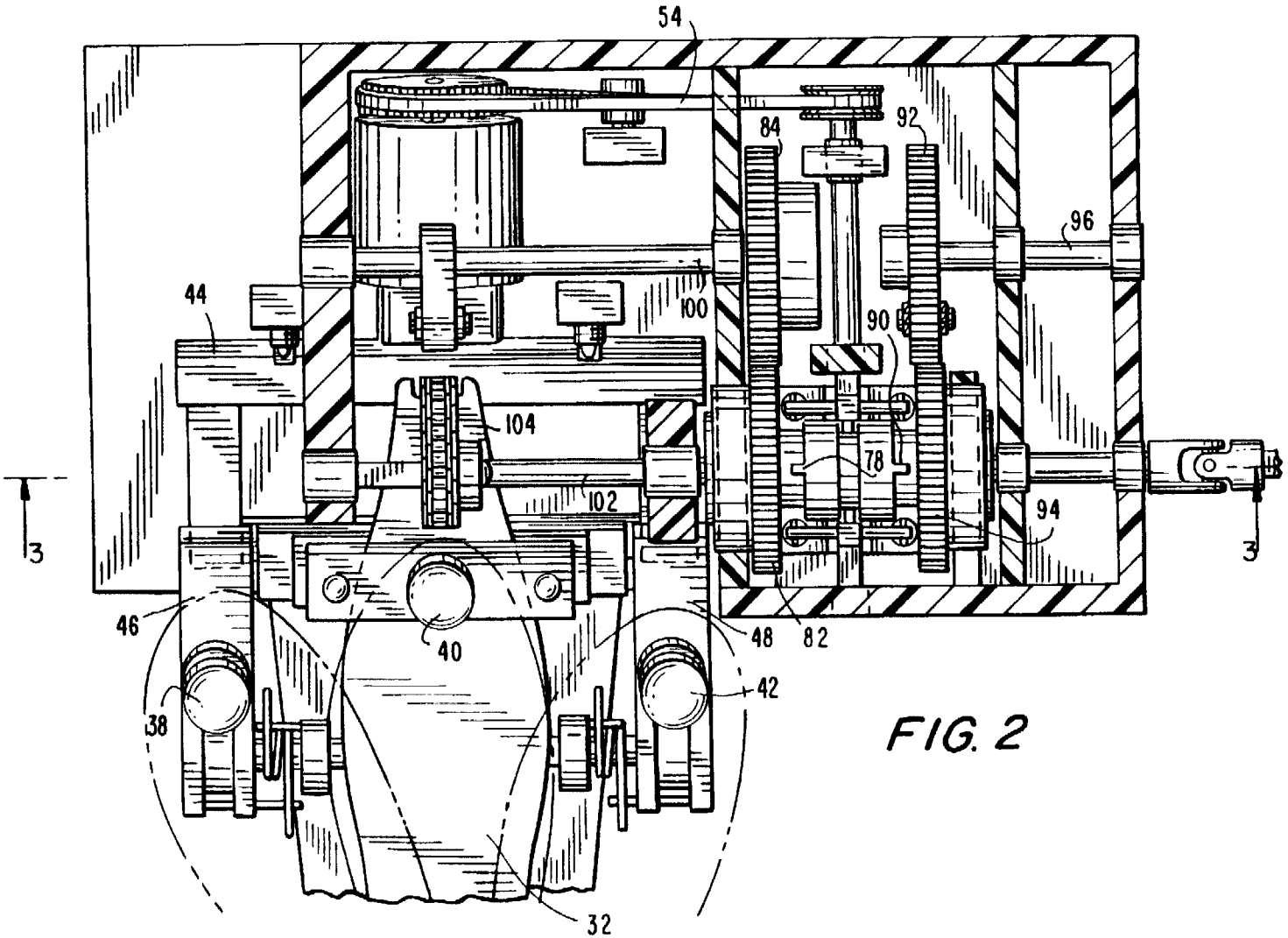
FIG. 2 is a sectional view of FIG. 1, taken along the line 2—2 of FIG. 1, and showing particularly the engagement mechanism for the first and second high hats, and the FIG. 2 mechanism being shown in position for actuation of the first beater for the bass drum.
Figure 3:
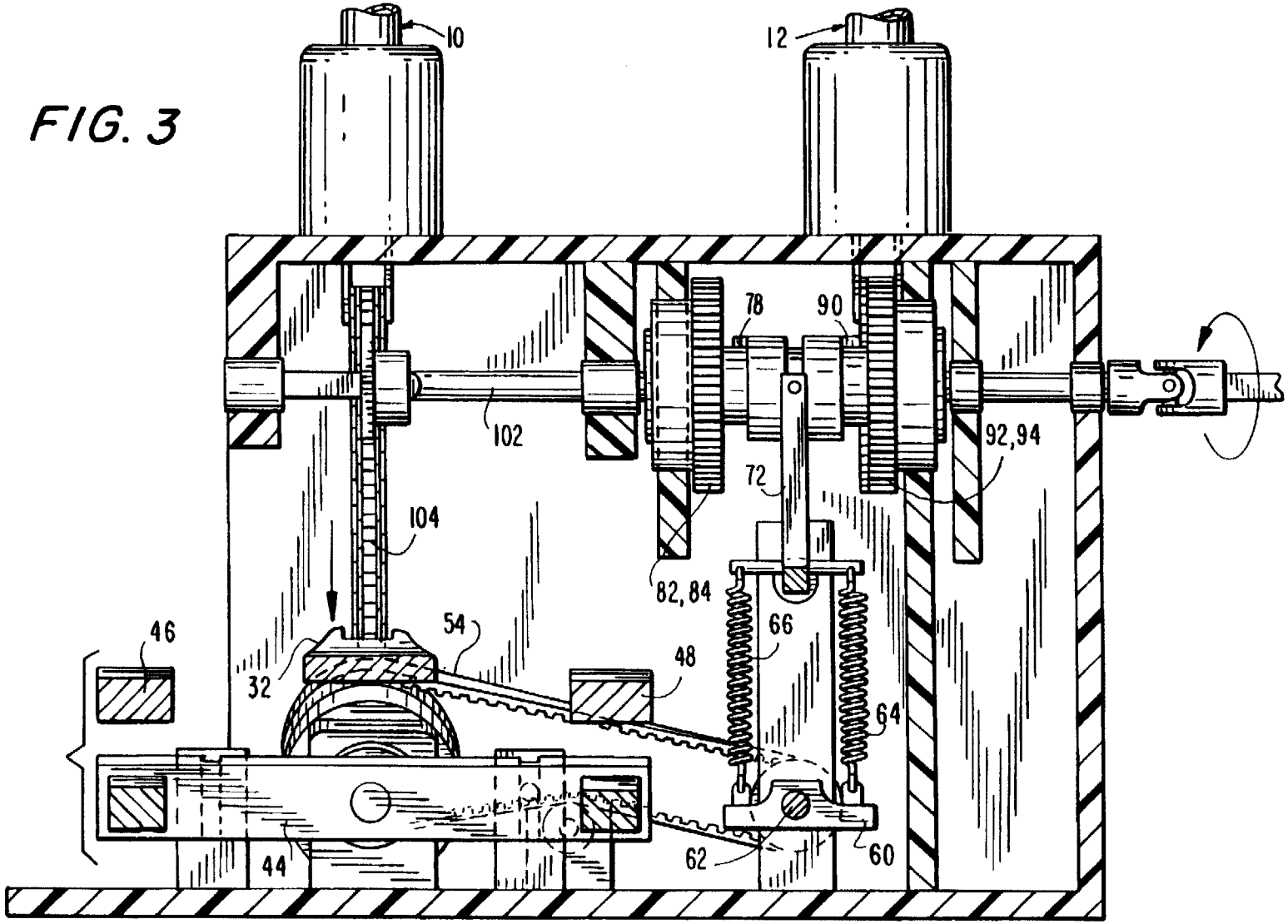
FIG. 3 is a sectional view, taken along the line 3—3 of FIG. 2 and showing particularly, as with FIG. 2, the position for beating the bass drum only, with the first drum beater, but also showing the mechanism for use of the first and second high hats.
Figure 4:
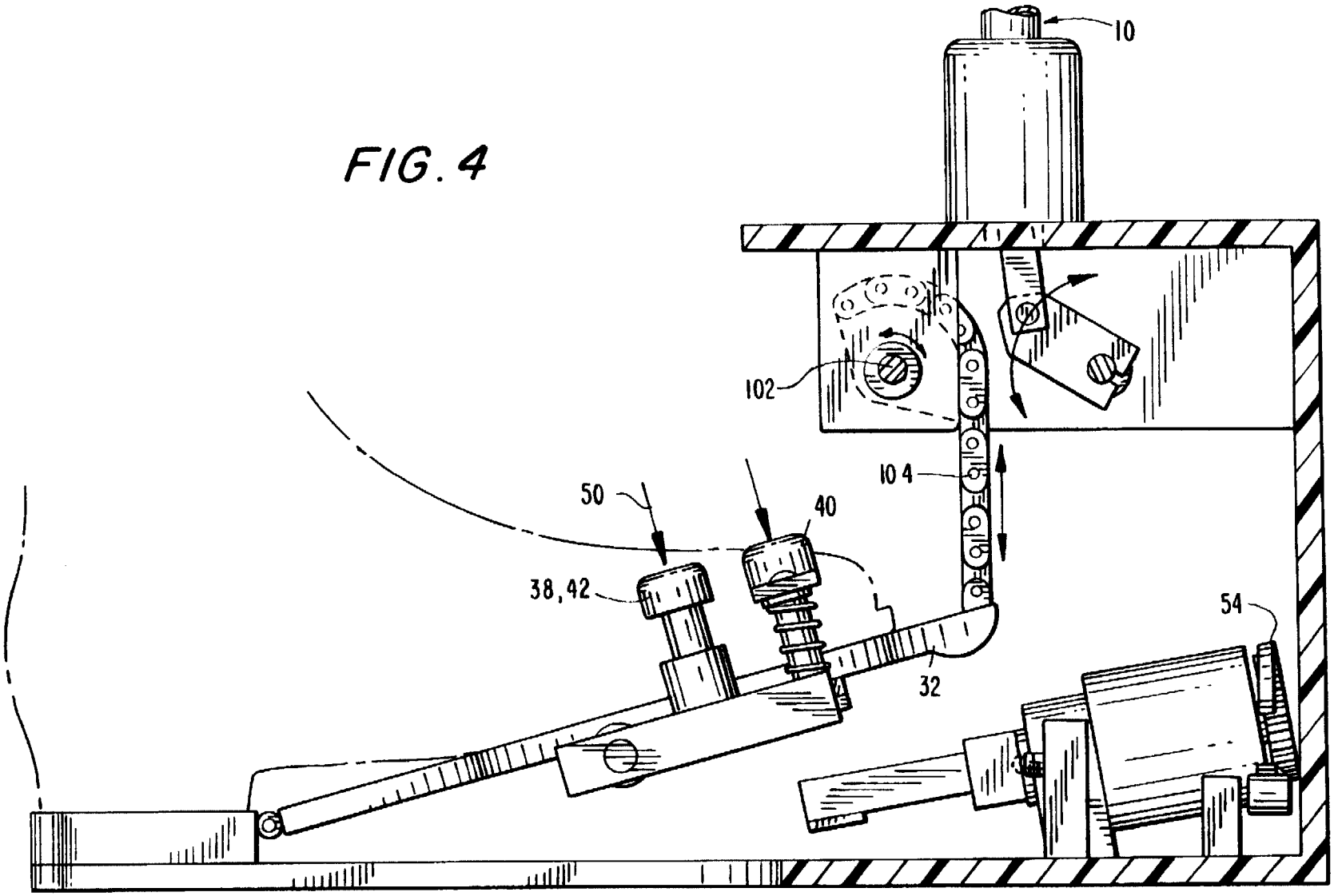
FIG. 4 is a view of the portion of the mechanism of FIG. 3, set up in the manner of FIG. 3 for beating the bass drum only, but also showing part of the actuation system for the first high hat.

Referring to FIG. 2 particularly, a high hat 10 and a second high hat 12 are coupled with bass drum 14. Such high hats 10, 12 and bass drum 14 are respectively actuated by up and down motion of cymbal shaft 16 in directions 18, 20, for the first high hat 10; up and down motion of cymbal shaft 22 in directions 24, 26 for second high hat 12; and by first and second drum beaters 28, 30. First high hat 10 actuation, second high hat 12 actuation and motion of first drum beater 28 are all accomplished by the drummer's foot motion on first pedal 32. Actuation of the second drum beater 30 is by the drummer's right foot pressure on second pedal 34.

As may be seen, the drummer's foot pressure as applied to the second pedal is most conveniently accomplished with the drummer's right foot, and, the actuation of the first foot pedal 32 is conveniently accomplished with the drummer's left foot. Accordingly, since the left foot of the drummer is for actuating one of the high hats, or for actuating the first drum beater on bass drum 36, a means is provided for selection of which actuation will occur by use of the drummer's left foot on first pedal 32. In this regard, FIG. 2 illustrates buttons 38, 40 and 42 mounted in association with first pedal 32. The mechanism shown is arranged so that, for instance, when button 38 is depressed, an up and down motion by the drummer's foot on first pedal 32 (the main body of the first pedal), actuation of first high hat 10 will be the result. Likewise, depressing button 42 will enable left foot pressure on the main body of pedal 32 to actuate the second high hat 12. Center button 40 is for actuation of the first drum beater 28 on the bass drum, by exertion of the drummer's left foot on first pedal 32.

Figure 5:
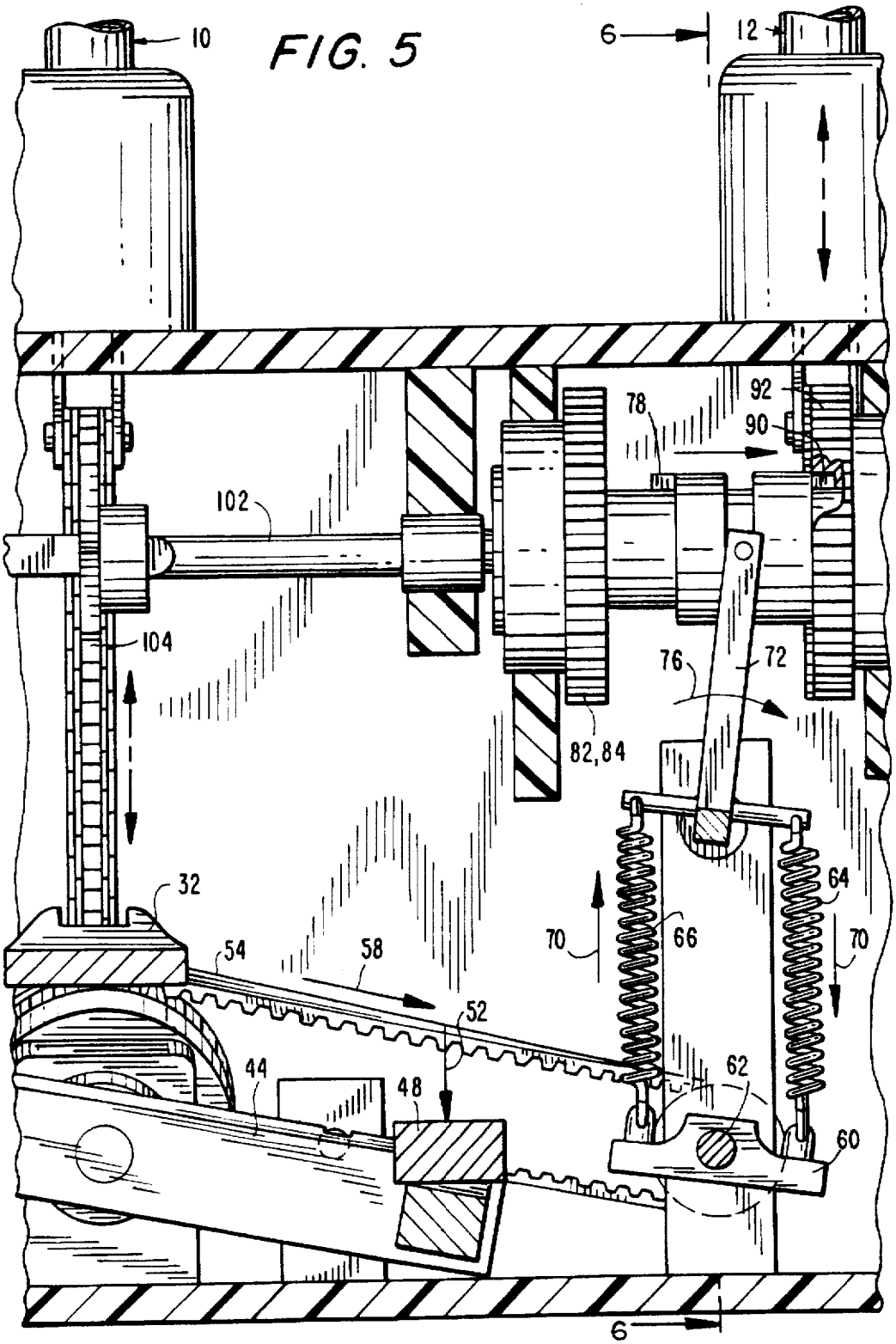
FIG. 5 is a partial and sectional view showing particularly the mechanism for actuating the second high hat.
Figure 6:
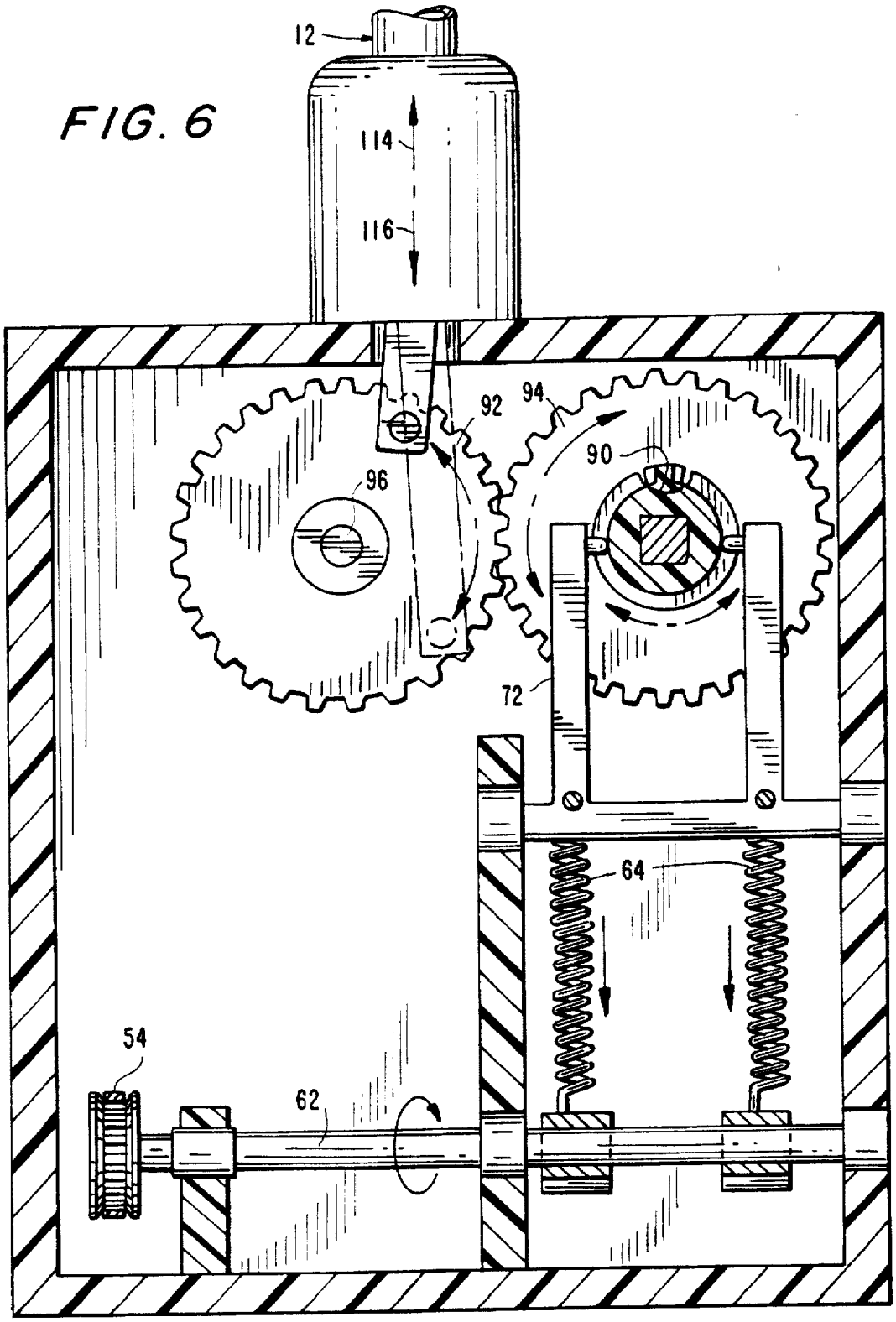
FIG. 6 is a sectional view, taken along the line 6—6 of FIG. 5, and showing particularly the gear arrangement and shift yoke for actuating the second high hat.

Generally, the mechanism shown in the drawings includes rocker arm 44 actuated by arm 46 to the left in the orientation of the drawings and arm 48 downward to the right, as moved in directions depicted by arrows 50, 52 by the use of respectively, buttons 38, 42. In other words, to actuate the first high hat, button 38 is pressed by the drummer with his left foot, which in turn, drives arm 46 in direction 50, and thereby tilts rocker arm 44 downwardly to the left. A downward motion to the right, of rocker arm 44 is provided by the drummer's depression of button 42. Such motion, in turn, provide a motion for belt 54, as shown on FIGS. 5 and 7 respectively, in terms of actuating the second or first high hat. In terms of actuation of the first high hat by depressing button 38, belt 54 moves in a counter-clockwise direction as shown by the direction of arrow 56. Conversely, a depression of button 42 will cause belt 54 to move in a clockwise direction as depicted by arrow 58.

Whichever direction belt 54 moves determines the motion, clockwise or counter-clockwise for yoke 60 about yoke shaft 62. In turn, the motion of yoke 60 moves springs 64, 66 (FIG. 5 and 7), either in directions depicted by arrows 68 in FIG. 7, or arrows 70 in FIG. 5, depending respectively, on whether the first or second high hat is being actuated.

At this point in the operation of the mechanism shown for the present invention, a determination is made by the direction of springs 64, 66 as to whether yoke arm 72 moves to the left in direction 74 for activating first high hat 10; or moves to the right in direction of arrow 76 (FIG. 5) to actuate second high hat 12.

Figure 7:
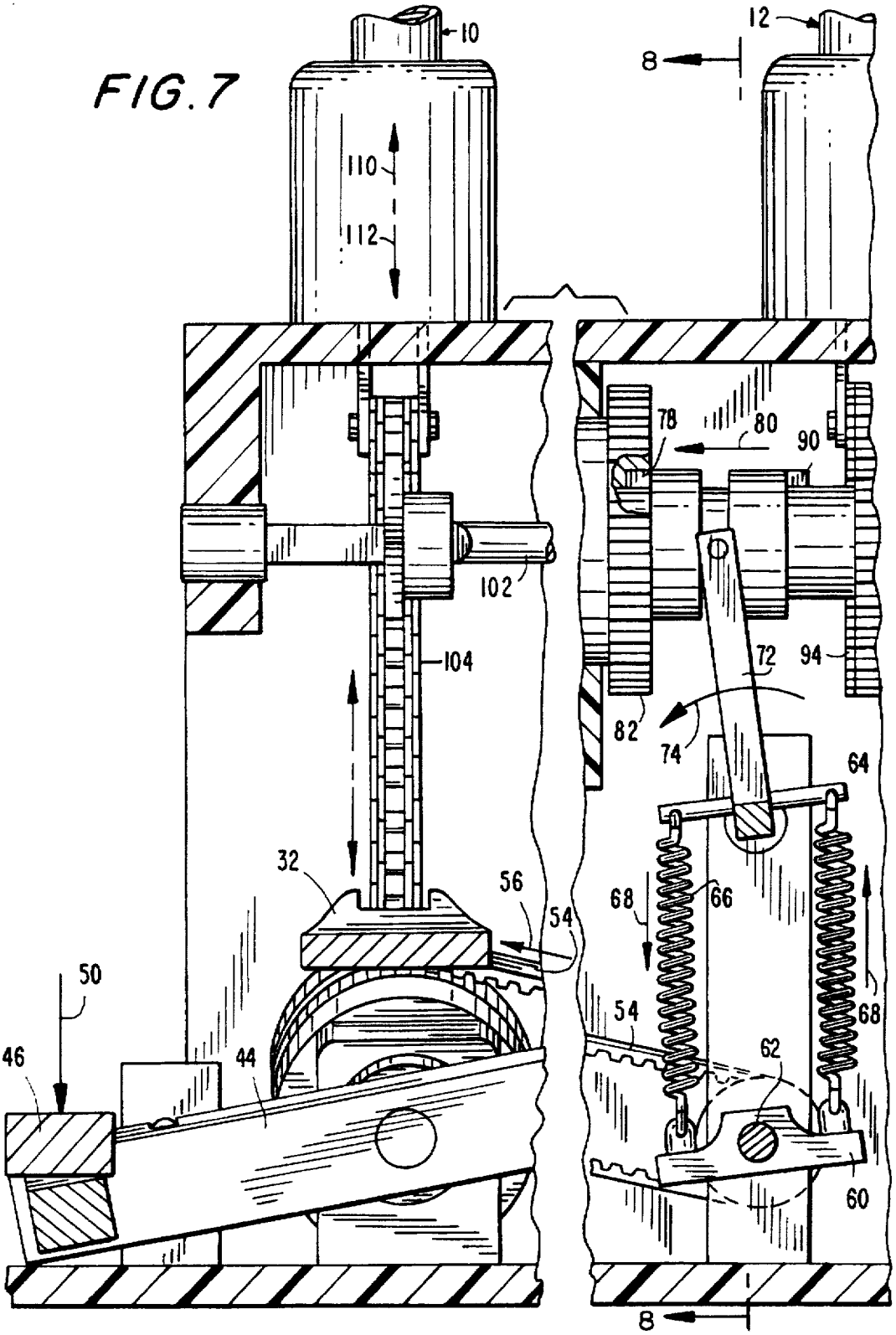
FIG. 7 is a view similar to the view of FIG. 5, but showing the mechanism for actuating the first high hat.
Figure 8:
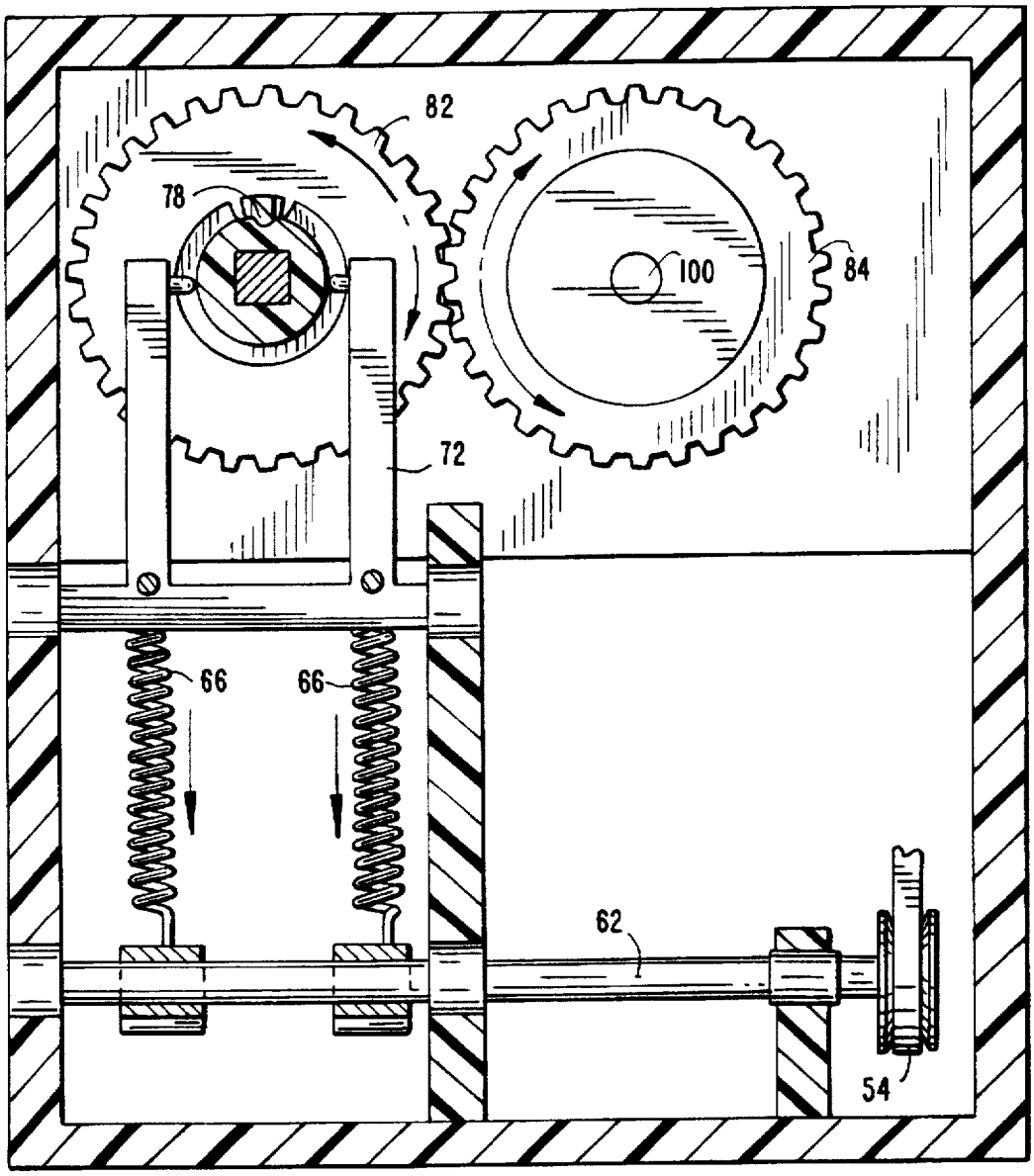
FIG. 8 is a sectional view, taken along the line 8—8 of FIG. 7 and showing the gear arrangement and yoke motion of the mechanism for actuating the first high hat.

For purposes of this description, reference to FIGS. 7 and 8 (actuation of first high hat 10) causes key slide engager 78 to move in direction 80 in order to couple gear 82, and thereby gear 84 for linking first high hat 10. The linkage, as described, for first high hat 10 enables downward motion of the main body of first pedal 32 to actuate cymbals 86, 88, as shown in FIG. 1. Likewise, an upward motion by the drummer's foot on first pedal 32 will disengage cymbals 86, 88 until further downward pressure is applied on the main body of pedal 32 by the drummer's left foot at which time the first high hat cymbals 86, 88 will again by actuated to clash together.

It is quite apparent that second high hat 12 is actuated in a similar manner, beginning with the pressing of button 42, and instituting motion and linkage through rocker arm 44 and yoke 60, and turning yoke shaft 62 in a direction to provide motion of yoke arm 72 in direction 76. This causes key slide engager 90 to engage gear 92, and in turn, to engage gear 94 for turning third drive shaft 96.

It may then be seen that depression of the second or middle button 40 produces a leveling of rocker arm 44, which prevents the insertion of either key slide engager 78 or key slide engager 90, thus preventing the turning of either of drive shafts 96 or 100. Instead, first drive shaft 102 is turned by the action of chain 104 thereby to actuate first drum beater 28 by the drummer depressing, and allowing to raise, first pedal 32.

The philosophy of the mechanism described herein is that a piston motion is imparted in directions 110, 112 for the first high hat or directions 114, 116 for the second high hat, by gear 82, or gear 92, respectively, depending upon whether or not gears 84 or 94 engaged to their shafts, depending upon, in turn, whether buttons 38 or 42 is depressed. The lack of such engagement of such gears enables the drive shaft to simply actuate through to the first drum beater onto the bass drum. It also is apparent from the foregoing that gears and chains can be used and are used interchangeably in the mechanism as described.

In this fashion, and with the mechanism described, and with the alternatives for the mechanism envisioned, the objectives of the present invention are fulfilled. In other words, a drummer, with the use of his two feet, is enabled to actuate a bass drum with the second pedal and the second drum beater. With the use of his left foot, the drummer can actuate any one of three mechanisms, relating to either a first high hat, a second high hat or the bass drum by use of a first drum beater.

In this respect, the scope of the present invention is to be determined only by the scope of the following claims:

What is claimed is:

1. A drum set having a bass drum with a first drum beater, a high hat cymbal element and a second high hat cumbal element, and a first pedal for actuating said first and second high hat cymbal elements and said first drum beater, comprising a mechanism for connecting said first pedal to, and for actuating said first and second high hat cymbal elements, and said first drum beater, selectively, and a plurality of buttons associated with said first pedal for selecting the high hat cymbal element, or the first drum beater, to be actuated by use of said first pedal.

2. The invention according to claim 1 wherein said drum set further comprises a second pedal to actuate said bass drum.

3. The invention according to claim 1 wherein said mechanism comprises a rocker arm for connecting said first pedal to said elements.

4. The invention according to claim 3 wherein said mechanism further includes a chain, a belt, gears and a slide key engager for said gears in order to provide said connection.

5. The invention according to claim 4 wherein said slide key engager operates to engage said gears for actuating said elements, and the lack of said engagement provides actuation for said first drum beater.

6. The invention according to claim 4 wherein said mechanism further comprises a shaft upon which said gears rotate.

* * * * *

UNITED STATES PATENT AND TRADEMARK OFFICE

Certificate

Patent No. 5,789,688 Patented: August 4, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Mark Schiano and Gregory Speckert.

Signed and Sealed this Twenty-Second Day of December, 1998.

BRIAN W. BROWN
*Special Program Examiner*
Technology Center 2800
Physics, Optics, Systems Components
and Electrical Engineering